US006745703B2

(12) United States Patent
Torrey et al.

(10) Patent No.: US 6,745,703 B2
(45) Date of Patent: Jun. 8, 2004

(54) COMPOSITE PALLET MEMBER

(75) Inventors: Bruce Torrey, Orlando, FL (US); Neil Schultz, Katonah, NY (US)

(73) Assignee: Chep International, Inc., Orlando, FL (US)

( * ) Notice: Subject to any disclaimer, the term of this patent is extended or adjusted under 35 U.S.C. 154(b) by 0 days.

(21) Appl. No.: 10/045,695

(22) Filed: Oct. 26, 2001

(65) Prior Publication Data

US 2003/0079658 A1 May 1, 2003

(51) Int. Cl.[7] ..... B65D 19/00
(52) U.S. Cl. ..... 108/51.11; 108/57.25
(58) Field of Search ..... 108/51.3, 51.11, 108/57.17, 57.19, 53.1, 57.25, 57.27, 57.29, 901, 902

(56) References Cited

U.S. PATENT DOCUMENTS

| | | | | |
|---|---|---|---|---|
| 2,544,657 | A | | 3/1951 | Cushman |
| 3,267,883 | A | | 8/1966 | Vissers |
| 3,587,479 | A | * | 6/1971 | Geschwender |
| 3,709,161 | A | * | 1/1973 | Kauffman |
| 3,719,157 | A | | 3/1973 | Arcocha et al. |
| 3,855,945 | A | | 12/1974 | Sebilleau et al. |
| 4,013,021 | A | * | 3/1977 | Steinlein et al. |
| 4,279,204 | A | | 7/1981 | Propst |
| 5,205,221 | A | * | 4/1993 | Melin et al. |
| 5,269,219 | A | * | 12/1993 | Juvik-Woods |
| 5,385,776 | A | | 1/1995 | Maxfield et al. |
| 5,414,970 | A | | 5/1995 | Bontrager et al. |
| 5,463,965 | A | | 11/1995 | Cordrey |
| 5,465,672 | A | | 11/1995 | Boyse et al. |
| 5,514,734 | A | | 5/1996 | Maxfield et al. |
| 5,516,552 | A | | 5/1996 | Bontrager et al. |
| 5,551,353 | A | | 9/1996 | Fiedler |
| 5,552,469 | A | | 9/1996 | Beall et al. |
| 5,555,820 | A | * | 9/1996 | Shuert |
| 5,590,501 | A | | 1/1997 | Stoddart et al. |
| 5,605,102 | A | * | 2/1997 | Simpson |
| 5,694,863 | A | * | 12/1997 | Chen |
| 5,747,560 | A | | 5/1998 | Christiani et al. |
| 5,769,001 | A | * | 6/1998 | Viessmann |
| 5,816,406 | A | * | 10/1998 | Jupille et al. |
| 5,830,548 | A | * | 11/1998 | Anderson et al. |
| 5,883,173 | A | | 3/1999 | Elspass et al. |
| 5,937,767 | A | * | 8/1999 | Togawa et al. |
| 5,972,448 | A | | 10/1999 | Frisk et al. |
| 6,029,583 | A | * | 2/2000 | LeTrudet |
| 6,060,549 | A | | 5/2000 | Li et al. |
| 6,156,835 | A | | 12/2000 | Anderson et al. |
| 6,227,515 | B1 | * | 5/2001 | Broyles |
| 6,283,044 | B1 | * | 9/2001 | Apps |
| 6,294,114 | B1 | | 9/2001 | Muirhead |
| 6,508,182 | B1 | * | 1/2003 | Smorgan et al. |
| 2001/0029874 | A1 | | 10/2001 | Muirhead |
| 2002/0030597 | A1 | | 3/2002 | Muirhead |
| 2002/0058082 | A1 | | 5/2002 | Muirhead |

FOREIGN PATENT DOCUMENTS

| | | | |
|---|---|---|---|
| DE | 295 10 312 U1 | | 10/1995 |
| JP | 6-239347 | * | 8/1994 |
| WO | WO 00/20495 | | 4/2000 |

* cited by examiner

*Primary Examiner*—Jose V. Chen
(74) *Attorney, Agent, or Firm*—Akerman Senterfitt

(57) ABSTRACT

A composite pallet member that provides enhanced performance characteristics. A composite pallet member comprising at least one deck member having a first surface and a second surface. The deck member having a plurality of open spaces and a strengthening layer positioned against at least one of the first surface and the second surface.

47 Claims, 6 Drawing Sheets

COMPOSITE PALLET MEMBER

CROSS REFERENCE TO RELATED APPLICATIONS (Not Applicable)

STATEMENT REGARDING FEDERALLY SPONSORED RESEARCH OR DEVELOPMENT (Not Applicable)

BACKGROUND OF INVENTION

1. Technical Field

The present invention relates generally to a pallet member. More particularly, the invention relates to a composite pallet member with enhanced physical properties.

2. Description of the Related Art

Pallets are used to serve several purposes which range from the loading of equipment, or the stacking of food items for transportation and storage. Regardless of the purpose, a pallet must maintain durability to serve the particular purpose for which it is being used. The vast majority of pallets have been primarily constructed of materials such as wood and plastics. However, most pallets become damaged during transit over the passage of time. For example, many pallets constructed from wood either break or become detached. Additionally, pallets constructed from plastic are often extremely expensive and remain susceptible to deterioration with normal wear and tear. Also, wooden and plastic pallets pose fire hazards due to the high flammability of the materials.

UL 2335 "Classification of Warehouse Pallets" establishes minimum requirements that pallets used and stored in warehouses should adhere to in order to obtain reduced restrictions and improved fire retardancy. For example, obtaining a UL 2335 classification allows plastic pallets to use the same code rules as wood pallets, thereby eliminating several of the imposed restrictions associated with plastic pallets. A UL 2335 classification permits the use of wood and/or plastic pallets with the use of specifically defined restrictions. Wood pallets provide the basis for most all fire protection systems, although these types of pallets are recognized as being extra hazardous. Pallets which are not classified under UL 2335 are penalized significantly more than wood pallets. The associated penalties influence the use of pallets within certain aspects. For example, penalties can include restrictions on a pallets stacking height, corresponding sprinkler protection systems, and other forms of restrictions which can become very expensive. Pallets which are classified under UL 2335 are allowed the same protection systems afforded to ordinary wooden pallets. Consequently, it is desirable to design pallets that can be used to serve normal functions such as for packaging and transporting of goods, while also maintaining durability and exhibiting fire retardant qualities under UL 2335.

Currently, pallet compositions do not possess superior qualities in regards to durability, nor the ability to maintain sufficient fire performance. Although some pallets may provide a few of these qualities, none are optimally suited for multiple purposes. Attempts have been made to overcome present pallet technology. For example, U.S. Pat. No. 6,180,037 discloses a method and composition for manufacturing sheets having a highly inorganically filled matrix. The inorganic sheets may exhibit properties substantially similar to sheets presently made from traditional materials like paper, cardboard, polystyrene, plastic, or metal. These inorganic sheets may prove to be beneficial in some instances, however many of the same concerns presented by lack of durability and strength are prevalent.

Nanocomposite technology refers to a relatively new class of plastics often derived from a highly defined form of bentonite that reacts with plastic resins. Nanocomposite polymers are prepared by fully dispersing or exfoliating intercalated clay platelets into a host polymer. U.S. Pat. No. 5,876,812 discloses nanocomposite polymer containers composed of a polymer material integrated with a plurality of nanosize particles of clay mineral which act to enhance the barrier properties of the container. The nanocomposite containers disclosed do not teach the use of additional substrate material to further reinforce the containers or pallets, nor the use of innovative design concepts to further structural integrity.

The prior art fails to address the need to have pallets and containers that improve the mechanical strength and durability of pallets and containers, while also providing increased thermal, barrier, and heat resistance properties, at economical prices.

SUMMARY OF INVENTION

The present invention relates to a composite pallet member that provides enhanced performance characteristics.

According to the invention, a composite pallet member can comprise a deck member having a first surface and a second surface. The deck member of the composite pallet member can include a plurality of open spaces located on the surface of the deck member. A strengthening layer can be positioned against at least one of the first surface and the second surface of the deck member. The plurality of open spaces and strengthening layer can provide enhanced strength. The plurality of open spaces can extend from the first surface toward the second surface. The plurality of open spaces also can extend from the second surface toward the first surface. Alternatively, the plurality of open spaces can extend from the first surface toward the second surface and also extend from the second surface toward the first surface. The open spaces can be arranged in a periodic relationship across the surface of the deck member and each open space can provide a closed end.

Several variations of the geometry of the open spaces may be incorporated into the composite pallet member. These differing variations in geometry can provide structural integrity and increased structural support. One embodiment of the invention can include a plurality of open spaces having a triangular geometry. In this embodiment, the plurality of open spaces are formed by three sidewalls arranged substantially in a triangular orientation. The space defined by the three sidewalls decreases in cross sectional area as the open spaces extend from the first surface toward the second surface. The space defined by the three sidewalls can decrease in cross sectional area as the open spaces extend from the second surface toward the first surface. The open spaces may vary in their positioning on the surface of the deck member depending on the particular pallet design. For example, in other embodiments of the invention the open spaces can be arranged in a honeycomb configuration or any other suitable configuration. The open spaces may be filled with foam, expanded metal, or a solid substrate. Additionally, the open spaces can be filled with intumescent paper, fiber sheets, coatings and fabrics. The filling of the open spaces provide additional reinforcement to the composite pallet member.

The deck member can be composed of a variety of materials such as wood, plastic, particle board and metal. The deck member also can be formed utilizing nanocomposite technology. Nancomposites utilize many different materials intermingled on a nanometer scale. Nanocomposites can be made from a variety of starting materials including, but not limited to gases, minerals, and plastics. Nanocomposite technology provides the benefit of increased physical properties. Nanocomposites can provide higher heat distortion temperatures, less shrinkage, less warping, electrical conductivity and better fire performance. The nanocomposites utilized in the composite pallet member can include an organic-inorganic complex of material. The deck member can be composed of a nanocomposite material comprising a polymer material integrated with a clay between 0.1% and 20% weight of the nanocomposite. The weight of the clay used in the nanocomposite comprising the deck member also can include clay between 0.1% and 10% and clay between 10% and 20% weight of the nanocomposite. The clay utilized can include a silicate or silicate derivative such as montmorillonite (alumino-silicate). Nanocomposite technology has demonstrated a significant reduction in heat release rates on the order of 50 to 75% while increasing stiffness, heat distortion temperatures, cold temperature impact and other barrier properties. Nanocomposites also can be utilized in conjunction with flame retardant resins. Flame retardant resins further enhance the fire resistance of pallets. Examples of fire performance enhancing resin technologies used are zirconia, boron oxides, polybenzoxazine, polymers and carbon-silicone resin additives.

The strengthening layer can be positioned against the surface of the deck member. The strengthening layer can be positioned to at least one of the first surface and the second surface of the deck member. The strengthening layer also can be positioned against both the first surface and second surface of the deck member in one embodiment. The deck member and strengthening layer provide the multiple layered pallet member with added durability and load support. The composite pallet member is resilient to normal wear and tear. Nanocomposite technology can be incorporated into the strengthening layer. The strengthening layer can be composed of a nanocomposite material comprising a polymer material integrated with a clay between 0.1% and 20% by weight of the nanocomposite. The weight of the clay used in the nanocomposite comprising the strengthening layer also can include clay between 0.1% and 10% and clay between 10% and 20% by weight of the nanocomposite. The strengthening layer also can be composed of materials such as wood, plastic, particle board, metal, or any other suitable material. The strengthening layer can be detachable or permanently attached to any surface of the deck member. For instance, the strengthening layer can be attached to the first surface of the deck member while no strengthening layer is attached to the second surface of the deck member. Conversely, a strengthening layer can be attached to the second surface of the deck member leaving the first surface without a strengthening layer. Additionally, a strengthening layer can be attached to the first surface of the deck member while a separate strengthening layer can be attached to the second surface of the deck member. The strengthening layer also can include a plurality of holes in its surface. The holes provide a mechanism that facilitates the release of fluids and gases from the surface of the deck member and strengthening layer.

The invention provides a composite pallet member where a plurality of legs can be mechanically integrated into the deck member. The legs also can be composed of a nanocomposite material comprising a polymer material integrated with a clay between 0.1% and 20% weight of the nanocomposite. The weight of the clay used in the nanocomposite comprising the legs also can include clay between 0.1% and 10% and clay between 10% and 20% weight of the nanocomposite. The composite pallet member also can include a plurality of deck members. The plurality of deck members provide additional support and structural integrity to the pallet member. In addition, the plurality of deck members also can include a plurality of open spaces which further compliment the particular design of the specific composite pallet member. The plurality of deck members also can be detachably coupled to form the shelving members. Shelving members can be adapted to provide additional storage space for the composite pallet member. The shelving members can be collapsible or foldable, which improves stacking and storage qualities as compared to traditional single layer pallets.

BRIEF DESCRIPTION OF THE DRAWINGS

The invention may be better understood by referring to the following description taken in conjunction with the accompanying drawings, it being understood, however, that the invention is not limited to the precise arrangements and instrumentalities shown.

DETAILED DESCRIPTION OF THE PREFERRED EMBODIMENTS

The present invention provides a composite pallet member 10 with enhanced physical properties. The invention provides a composite pallet member 10 comprised of various layers of material with fire retardant capabilities and increased durability against normal wear and tear.

Figure 1:
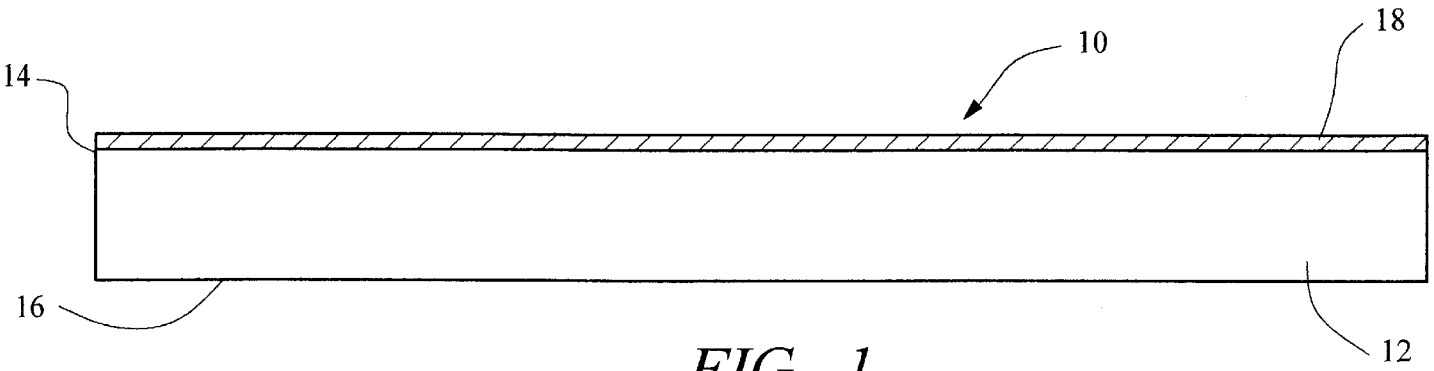
FIG. 1 shows a perspective view of a composite pallet member.
Figure 2:
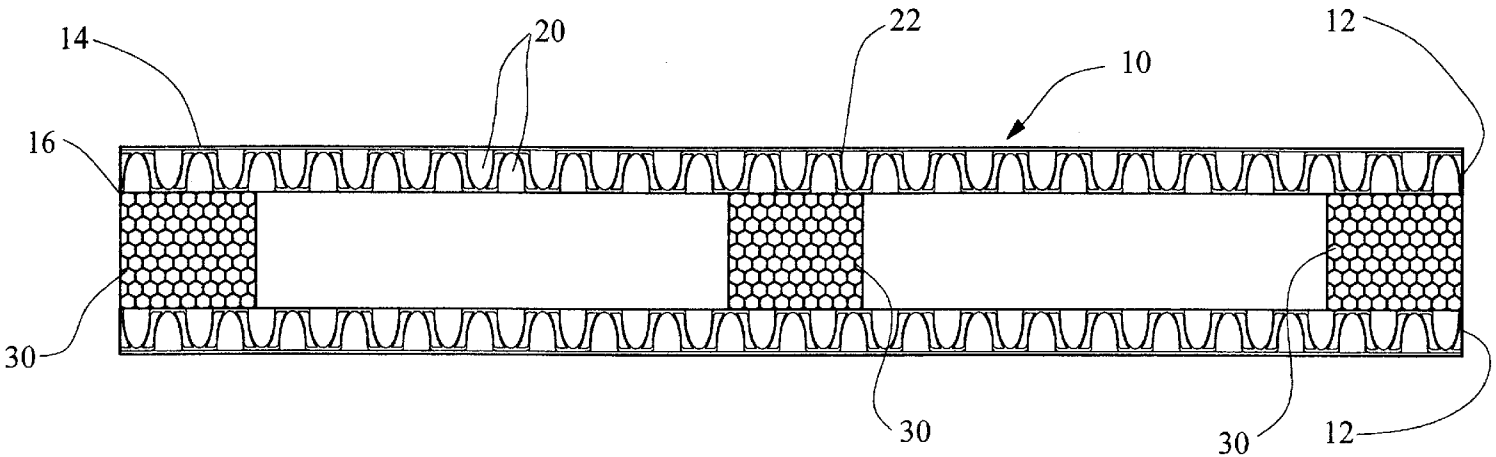
FIG. 2 shows a front view of an embodiment of a composite pallet member prior to addition of strengthening layer.

FIG. 1 depicts an embodiment of the invention which provides a composite pallet member. The present invention comprises a deck member 12 having a first surface 14 and a second surface 16. A strengthening layer 18 is positioned against at least one of the first surface 14 and the second surface 16 of the deck member 12. As shown in FIG. 2, the deck member 12 can include a plurality of open spaces 20 located on the surface of the deck member 12. The combination of the strengthening layer 18 and the open spaces 20 provide the composite pallet member with a light weight and additional strength. The plurality of open spaces 20 provided by the deck member 12 can extend from the first surface 14 toward the second surface 16. The plurality of open spaces 20 also can extend from the second surface 16 toward the first surface 14. The placement and orientation of the open spaces 20 located on the surface of the deck member 12 can vary depending on the particular design of the composite pallet member. For example, open spaces 20 also can be provided on the first surface 14 while none are provided on the second surface 16. Alternatively, open spaces 20 can be provided on the second surface 16 and not be provided on the first surface 14. The open spaces 20 also can be included on both the first surface 14 and second surface 16 of the deck member 12. Regardless of the surface where the open spaces 20 are located, the open spaces 20 can extend toward the opposite surface. The open spaces 20 can be arranged in a periodic relationship across the surface of the deck member 12 and each open space 20 can provide a closed end. The closed end of the open spaces 20 provide additional stability within the particular pallet design constructed from the pallet member. The geometry of the open spaces 20 incorporated into the surface of the deck member 12 can include several variations. The geometric arrangement of the open spaces 20 across the deck member 12 supports the stability and strength of the design of the composite pallet member 10.

Figure 3:
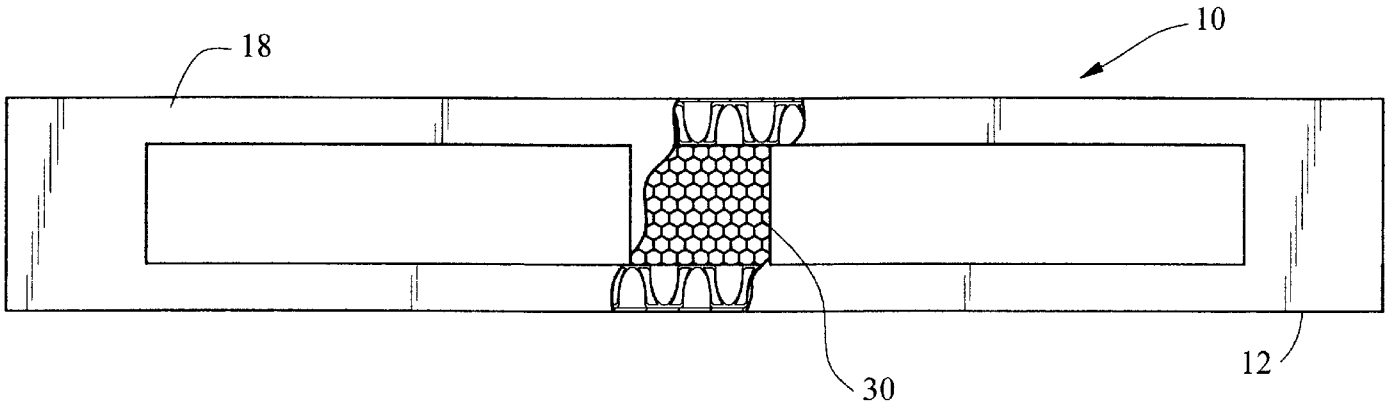
FIG. 3 shows a front view of an embodiment of a composite pallet member with attached strengthening layer.

The strengthening layer 18 can be positioned against the surface of the deck member 12. As depicted in FIG. 2, prior to the addition of the strengthening layer 18 the deck member 12 remains exposed to surface elements, which can contribute to normal wear and tear during usage. The strengthening layer 18 can be positioned to at least one of the first surface 14 and the second surface 16 of the deck member 12. A strengthening layer 18 can be positioned against both the first surface 14 and the second surface 16 of the deck member 12 in one embodiment. The deck member 12 and strengthening layer 18 provide a multiple layered composite pallet member 10 with added durability and load support. As shown in FIG. 3, the composite pallet member 10 has enhanced physical durability against deterioration by the addition of the strengthening layer 18.

Figure 4:
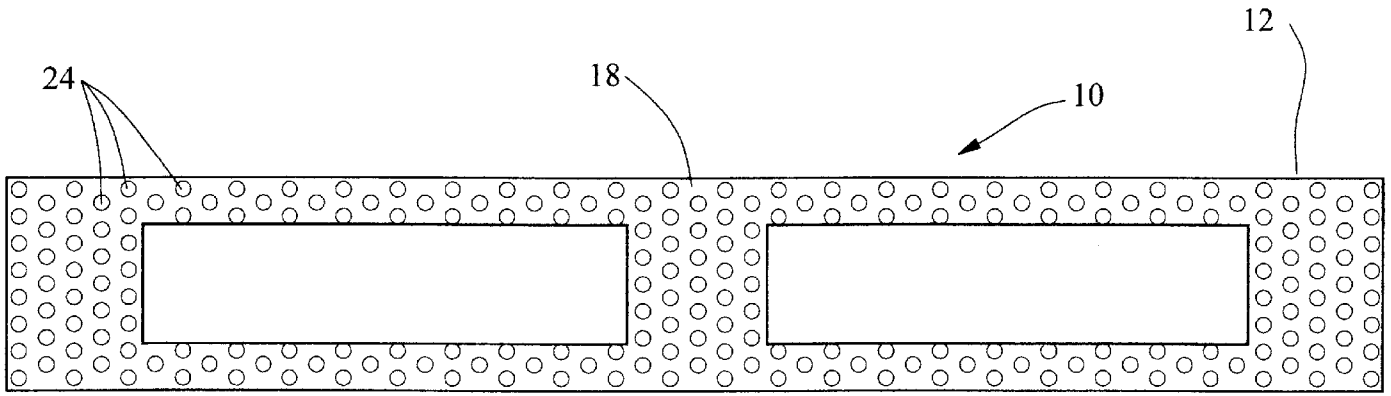
FIG. 4 shows a front view of a composite pallet member with holes incorporated into the surface of strengthening layer.

Nanocomposite technology can be incorporated into the strengthening layer 18. The strengthening layer 18 can be composed of a nanocomposite material comprising a polymer material integrated with a clay between 0.1% and 20% by weight of the nanocomposite. The weight of the clay used in the nanocomposite comprising the strengthening layer 18 can include clay between 0.1% and 10% and clay between 10% and 20% by weight of the nanocomposite. The strengthening layer 18 also can be composed of materials such as wood, plastic, particle board, metal, or any other suitable material. The strengthening layer 18 can be detachable or permanently attached to any surface of the deck member 12. For instance, a strengthening layer 18 can be attached to the first surface 14 of the deck member 12 while no strengthening layer 18 is attached to the second surface 16 of the deck member 12. Conversely, a strengthening layer 18 can be attached to the second surface 16 of the deck member 12 leaving the first surface 14 without a strengthening layer 18. Additionally, a strengthening layer 18 can be attached to the first surface 14 while a separate strengthening layer 18 can be attached to the second surface 16 of the deck member 12. The strengthening layer 18 can also include a plurality of holes 24 in its surface, as shown in FIG. 4. The plurality of holes 24 provide a mechanism that facilitates the release of fluids and gases from the surface of the deck member 12 and strengthening layer 18.

Figure 5:
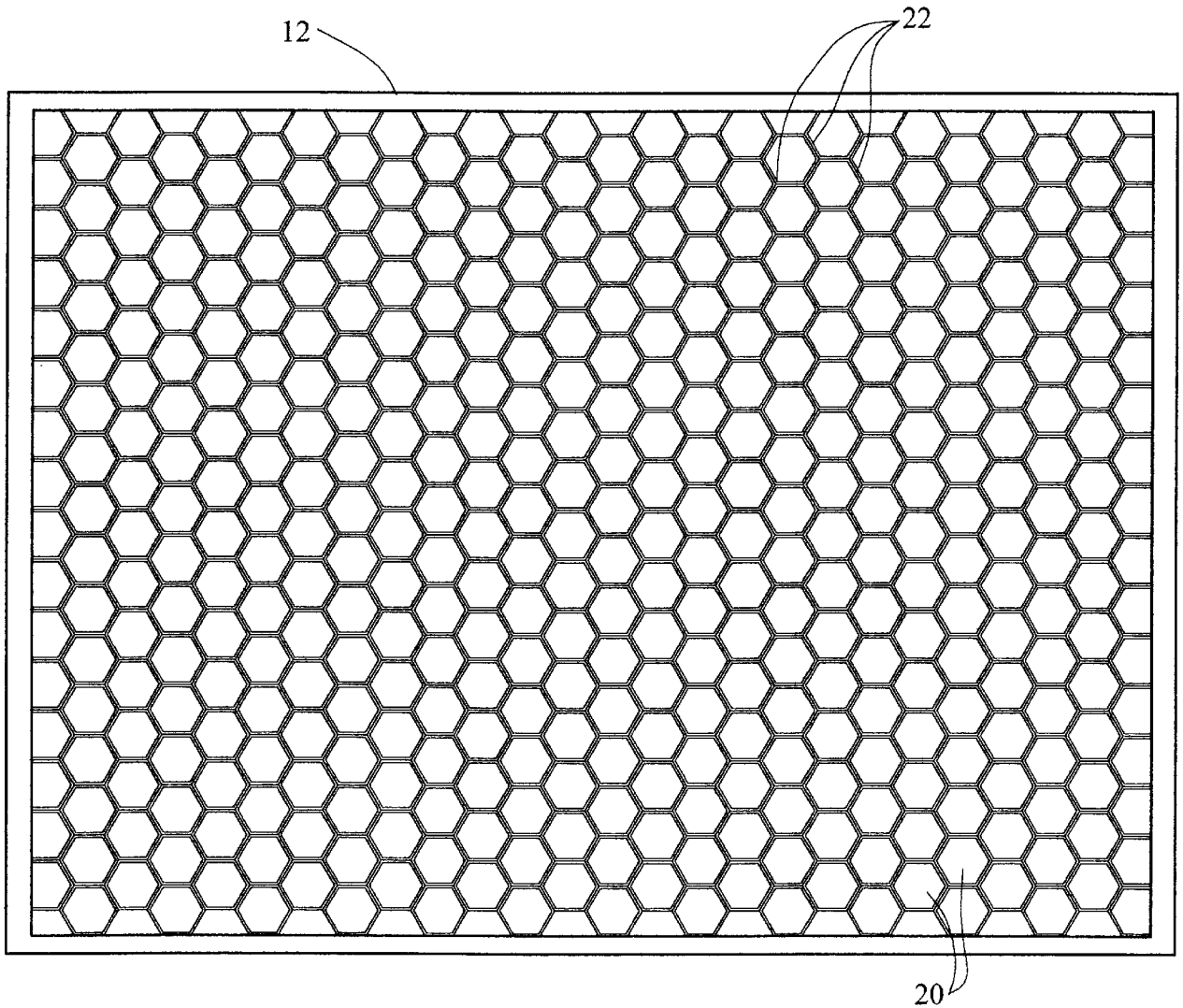
FIG. 5 shows a front view of open spaces located on the surface of the deck member of the composite pallet member.

The deck member 12 can include a plurality of open spaces 20 having a triangular geometry. In this embodiment, the plurality of the open spaces 20 are formed by three sidewalls arranged substantially in a triangular orientation. The space defined by the three sidewalls decreases in cross sectional area as the open spaces 20 extend from the first surface 14 toward the second surface 16. Additionally, if open spaces 20 are located on the second surface 16, the spaced defined by the three sidewalls decreases in cross sectional area as the open spaces 20 extend from the second surface 16 toward the first surface 14. The positioning of the open spaces 20 on the surface of the deck member 12 may vary according to the particular pallet design constructed from the composite pallet member. The configuration of the open spaces 20 is not limited to any particular design and can be arranged in a suitable configuration based on the specific use and purpose of the composite pallet member 10. One particular example of a suitable configuration includes a honeycomb configuration 22, as illustrated in FIG. 5. The configuration 22 of the open spaces provide the composite pallet member 10 with equalized load support across the surface of the deck member 12. The configuration 22 of the open spaces also provides increased stability against horizontal and vertical forces that effectively minimize wear and tear on the composite pallet member 10. Minimizing normal wear and tear extends the life of the composite pallet member 10.

The open spaces 20 can be filled with foam, expanded metal, or a solid substrate. Additionally, the open spaces 20 can be filled with intumescent paper, fiber sheets, coatings and fabrics. The hollow shapes of the potential pallet designs allow the placement or encapsulation of various forms of sheet, fabric and coating materials into the pallet before complete assembly of the pallet. The open spaces 20 are not limited to a particular material for filling and can be filled with any suitable material. However, considerations related to fire safety should be taken under consideration during selection of an adequate material. The filling of the open spaces 20 provides additional reinforcement for the composite pallet member 10.

The composite pallet member 10 can be utilized in forming a pallet. As illustrated in FIG. 2, the pallet can be comprised using multiple composite pallet members adhered together with pallet material 30. The pallet material 30 also can be used between the composite pallet members to separate pallet members 10 and provide structural support to the design of the pallet. Alternatively, the composite pallet member 26 can independently serve as a pallet, as shown in FIG. 1. In this embodiment, the deck member 12 and strengthening layer 18 comprise the structure for the pallet design.

The deck member 12 can be composed of a variety of materials such as wood, plastic, particle board and metal. The deck member 12 is not limited to a particular type of material for construction, although attention to design structure and intended use should be factors to consider. The deck member 12 also can be formed utilizing nanocomposite technology. Composition of the composite pallet member 10 utilizing nanocomposite technology involves the intermingling of different materials on a nanometer scale. Nanocomposites can be made from a variety of materials including gases, minerals, and plastics. Although the composition of a nanocomposite is not limited to any particular type of material, it usually refers to the combination of plastics often derived from a highly refined form of bentonite that reacts with plastic resin. Nanocomposites are prepared by fully dispersing or exfoliating intercalated clay into a host polymer.

Nanocomposites exhibit structural, thermal, mechanical, and barrier properties. Nanocomposite technology provides the benefit of increased physical properties. Nanocomposites can provide higher heat distortion temperatures, less shrinkage, less warping, electrical conductivity and better fire performance. The nanocomposites utilized in the composite pallet member 10 can include an organic-inorganic complex of material. The deck member 12 can be composed of a nanocomposite material comprising a polymer material integrated with a clay between 0.1% and 20% by weight of the nanocomposite. The weight of the clay used in the nanocomposite comprising the deck member 12 also can include clay between 0.1% and 10% and clay between 10% and 20% by weight of the nanocomposite. The clay utilized can include a silicate or silicate derivative such as Montmorillonite (alumino-silicate).

Montmorillonite can be employed in the preparation of polymer-clay nanocomposites. Montmorillonite provides performance advantages compared to traditional reinforcing agents for plastics. Montmorillonite can provide reinforcement to the pallet member and add to the overall strength of the pallet member. Other advantages of utilizing Montmorillonite includes providing lighter plastic parts with greater transparency. With Montmorillonite, the plastic will have increased barrier properties to moisture, solvents, chemical vapors, and gases. Montmorillonite leads to an improved permeation barrier. With Montmorillonite, the plastic will have increased dimensional stability at low reinforcement loading. The resulting plastic will have a higher heat distortion temperature. Only a few percent loading of Montmorillonite will increase the temperature at which the plastic will begin to soften. Pallet members 10 composed with Montmorillonite also provide increased durability in heat sensitive applications. The incorporation of Montmorillonite improves upon the ability to recycle pallet members 10. Due to the colloidal nature, high surface area, and surface treatability of montmorillonite, it can serve as an active site to fix dyes into plastic.

Nanocomposite technology has demonstrated a significant reduction in heat release rates on the order of 50 to 75% while increasing stiffness, heat distortion temperatures, cold temperature impact and other barrier properties. Nanocomposites also can be utilized in conjunction with flame retardant resins. Flame retardant resins further enhance the fire resistance of pallet members 10. Examples of fire performance enhancing resin technologies used are zirconia, boron oxides, polybenzoxazine, polymers and carbon-silicone resin additives. Nanocomposites offer a new flame-retardant approach. The improved flame retardancy shows a decrease in the peak heat release rate, decrease in smoke, and an increase in char formation. The nanocomposite particles are smaller than traditional reinforcing agents and provide a smooth surface.

Figure 6:
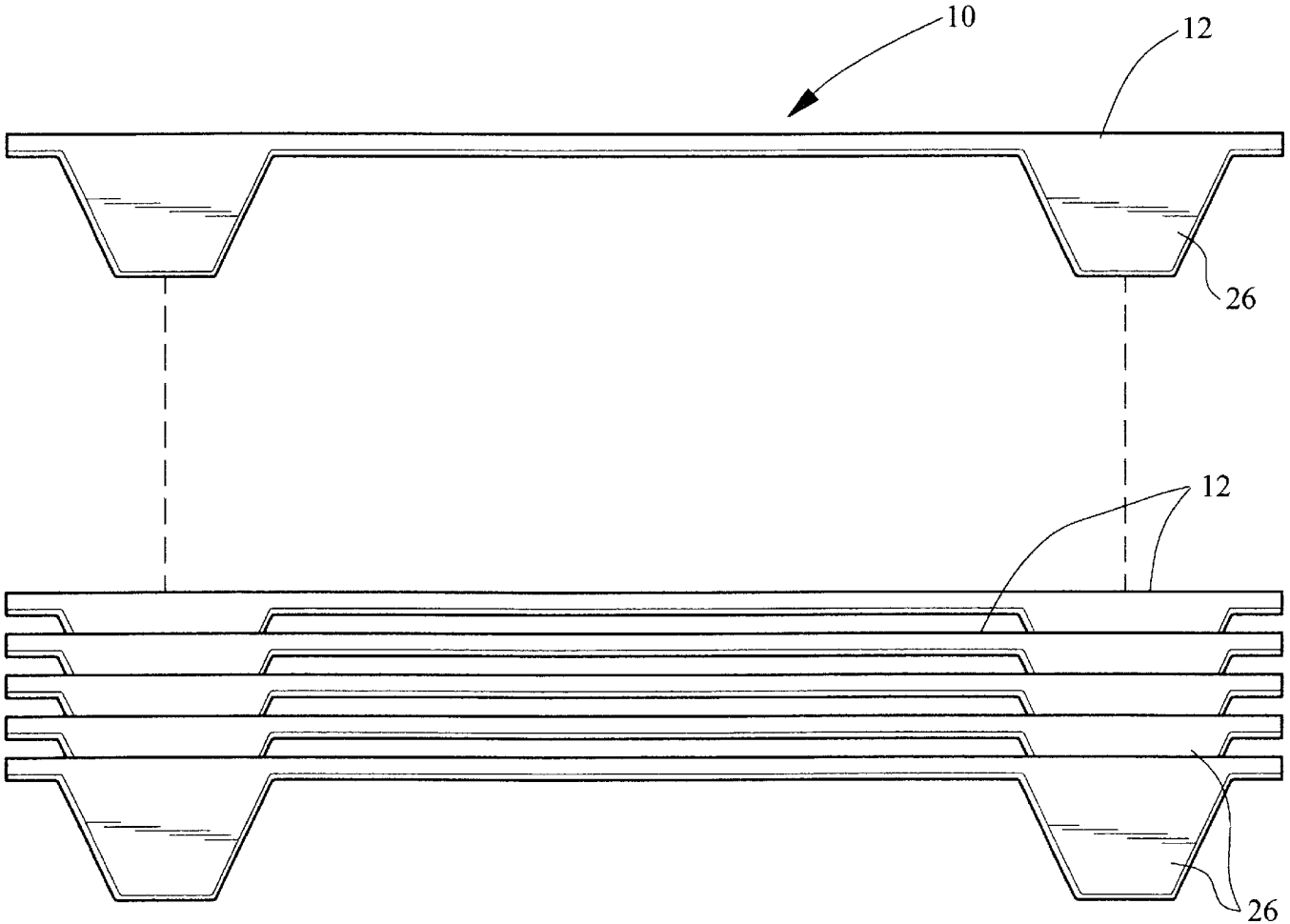
FIG. 6 shows a front view of a composite pallet member with nestable legs.
Figure 7:
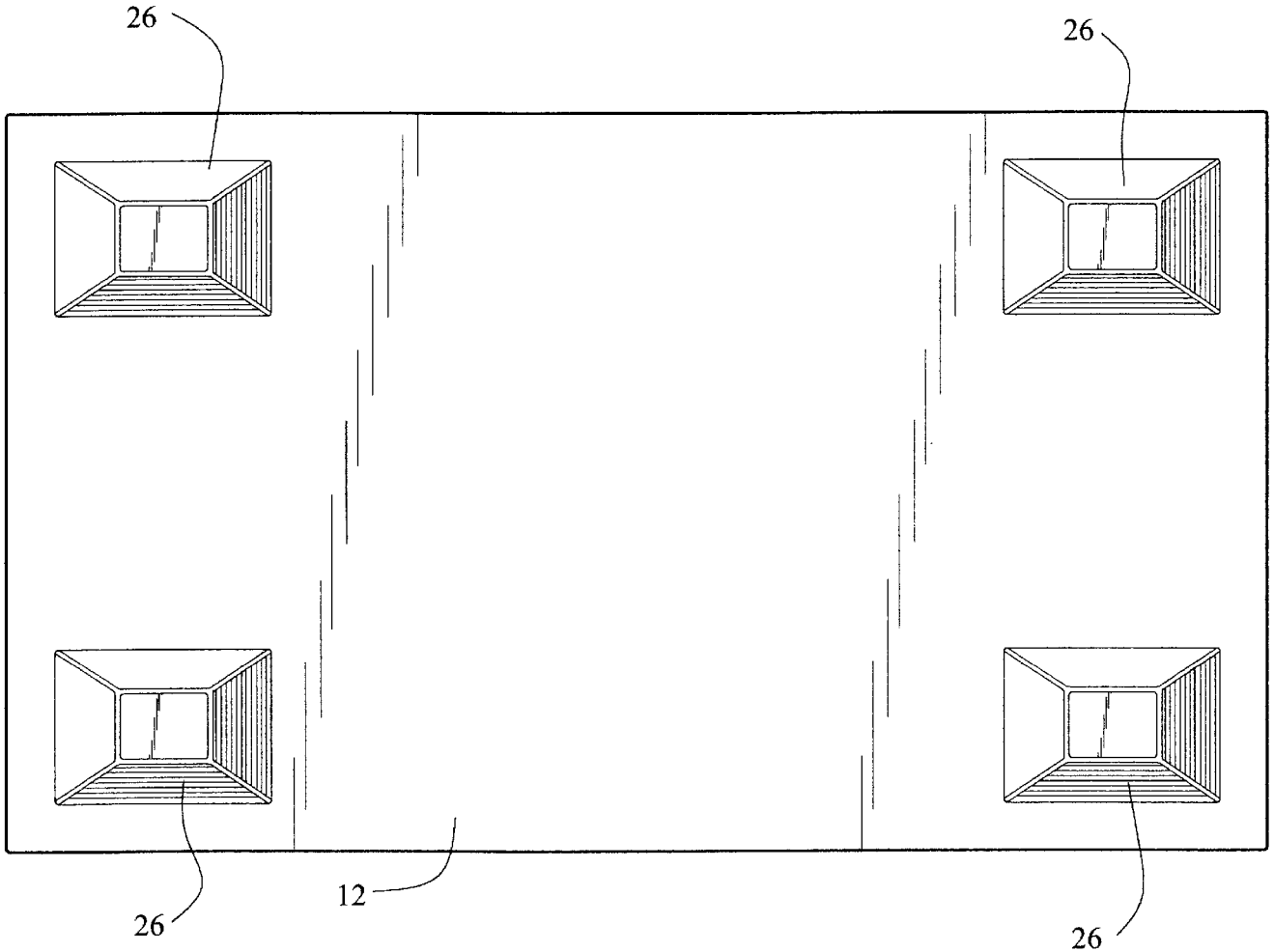
FIG. 7 shows a top view of a composite pallet member with nestable legs.

An embodiment of the present invention, as illustrated in FIG. 6, can include a composite pallet member 10 with a plurality of legs 26 mechanically integrated to the deck member 12. The legs 26 can be composed of a nanocomposite material comprising a polymer material integrated with a clay between 0.1% and 20% by weight of the nanocomposite. The weight of the clay used in the nanocomposite comprising the legs 26 can include clay between 0.1% and 10% and clay between 10% and 20% by weight of the nanocomposite. The legs 26 can be integrated into the design of the pallet member 10 during the initial molding process. For example injection molding can be suited to form the legs 26. Other processes suitable for forming the legs 26 include thermoforming, stamping, and extruding. The integration of legs 26 provide nesting ability and added structural support. For example, nesting ability allows pallet members to be stacked, which can be extremely beneficial during storage and transporting. As shown in FIG. 7, the deck member 12 can include integrated leg 26 on the surface of the deck member. The first surface of the deck member can provide a first surface of the legs 26. Additionally, the second surface of the deck member can provide a second surface of the legs 26. The resulting legs 26 can extend from the first surface toward the second surface forming an opening on the surface. The opening allows the pallet members to be stacked. The geometry of the legs 26 can vary depending on the design of the particular legs. For example, a deck member can feature legs 26 in a pyramidal geometry. The addition of the strengthening layer can be included on the legs 26. The strengthening layer can be positioned against at least one of the first surface and second surface of the deck member.

Figure 8:
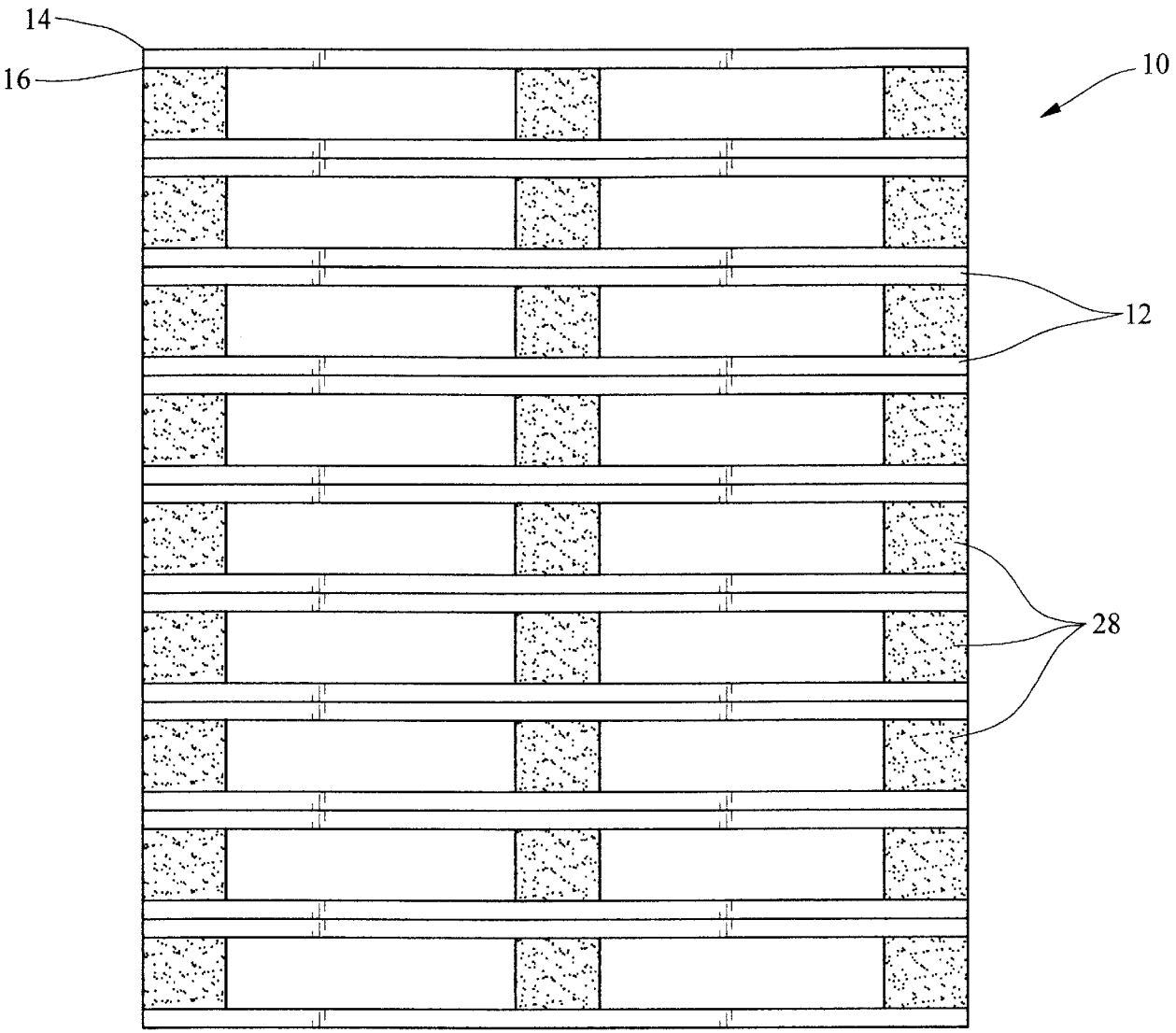
FIG. 8 shows a front view of a composite pallet member with a plurality of deck members forming a shelving member.

Another embodiment of the present invention illustrated in FIG. 8, includes a composite pallet member 10 with a plurality of deck members 12. The plurality of deck members 12 provide additional support and structural integrity to the pallet member. The plurality of deck members 12 also can be incorporated into the composite pallet member 10 to provide the pallet member with shelving members 28. The plurality of deck members 12 can be detachably coupled to form the shelving members 28. Shelving members 28 provide additional storage space for the composite pallet member 10. A composite pallet member 10 with shelving members 28 can be useful in any industry that involves the need for storage or shelving capacity. For instance, in grocery stores the composite pallet member 10 can be used to store food and other related items in an efficient manner. Additionally, in warehouse facilities, the composite pallet member 10 can be used to store a multitude of items while providing the ability to be broken down into smaller units with collapsible shelving members 28, or to be completely removed. The composite pallet member 10 also provides safety and fire security under storage conditions. The collapsible shelving members 28 provide the composite pallet member 10 the ability to be broken down into several individual units. The individual units can be utilized for material handling, display platforms or can be reassembled into other components to form larger pallet assemblies.

It will of course be understood that the invention is not limited to the specific details described herein, which are given by way of example only, and that various modifications and alterations are possible within the scope of the invention as defined in the appended claims. For example, the composite pallet member 10 can include variations in the number of deck members 12, configurations of open spaces 20, and placement of strengthening layer 18, and remain within the scope of the invention.

What is claimed:

1. A composite pallet member comprising:

at least one deck member having a first surface and a second surface;

said deck member having a plurality of open spaces, said open spaces extending between said first and second surfaces; and a strengthening layer positioned against at least one of said first surface and said second surface, wherein said deck member is composed of a nanocomposite material comprising a polymer material integrated with a clay, said clay comprising between 0.1% and 20% by weight of said nanocomposite.

2. The composite pallet member according to claim 1, wherein a first set of said plurality of open spaces extend from openings in said first surface toward said second surface and terminate in a closed end at said second surface, and a second set of said plurality of open spaces extend from openings in said second surface toward said first surface and terminate in a closed end at said first surface.

3. The composite pallet member according to claim 2, wherein said plurality of open spaces decrease in cross sectional area as said open spaces extend toward their respective closed ends.

4. The composite pallet member according to claim 1, wherein said plurality of open spaces are arranged in a honeycomb configuration.

5. The composite pallet member of claim 1, further comprising a strengthening layer positioned against said first surface and a strengthening layer positioned against said second surface.

6. The composite pallet member according to claim 1, wherein said deck member is composed of at least one material chosen from the group of materials consisting of wood, plastic, particle board and metal.

7. The composite pallet member according to claim 1, wherein said pallet member further comprises a plurality of deck members having a plurality of open spaces.

8. The composite pallet member according to claim 1, wherein said clay comprises between 0.1% and 10% by weight of said nanocomposite.

9. The composite pallet member according to claim 1, wherein said clay comprises between 10% and 20% by weight of said nanocomposite.

10. The composite pallet member according to claim 1, wherein said nanocomposite material comprises flame retardant resins.

11. The composite pallet member according to claim 1, wherein said nanocomposite material comprises a clay that includes a silicate derivative.

12. The composite pallet member according to claim 1, wherein said strengthening layer is composed of at least one material chosen from the group of materials consisting of wood, plastic, particle board and metal.

13. The composite pallet member according to claim 1, wherein said strengthening layer is composed of a nanocomposite material comprising a polymer material integrated with a clay, said clay comprising between 0.1% and 20% by weight of said nanocomposite.

14. The composite pallet member according to claim 13, wherein said strengthening layer clay comprises between 0.1% and 10% by weight of said nanocomposite.

15. The composite pallet member according to claim 13, wherein said strengthening layer clay comprises between 10% and 20% by weight of said nanocomposite.

16. The composite pallet member according to claim 1, wherein said strengthening layer is attached to at least one of said first surface and said second surface.

17. The composite pallet member according to claim 1, wherein said strengthening layer is detachably coupled to at least one of said first surface and said second surface.

18. The composite pallet member according to claim 1, wherein said strengthening layer includes a plurality of holes.

19. The composite pallet member according to claim 1, wherein said plurality of open spaces are filled with at least one filler selected from the group consisting of foam, expanded metal and solid substrate.

20. The composite pallet member according to claim 1, wherein said pallet member includes a plurality of mechanically integrated legs.

21. The composite pallet member according to claim 20, wherein said legs are composed of at least one material chosen from the group of materials consisting of wood, plastic, particle board and metal.

22. The composite pallet member of claim 20, wherein said legs are composed of a nanocomposite material comprising a polymer material integrated with a clay, said clay between 0.1% and 20% by weight of said nanocomposite.

23. The composite pallet member of claim 22, wherein said clay in said legs comprises between 0.1% and 10% by weight of said nanocomposite.

24. The composite pallet member of claim 22, wherein said clay in said legs comprises between 10% and 20% by weight of said nanocomposite.

25. The composite pallet member according to claim 1, wherein a plurality of deck members are attached to a surface of said deck member forming a shelving member.

26. The composite pallet member according to claim 25, wherein said plurality of deck members are detachably coupled to said deck member to form said shelving member.

27. The composite pallet member according to claim 25, wherein said plurality of deck members are collapsible.

28. The composite pallet member according to claim 1, wherein said strengthening layer completely closes said open spaces in said at least one surface.

29. The composite pallet member according to claim 28, wherein said strengthening layer completely closes said open spaces in both said first and second surfaces.

30. The composite pallet member according to claim 1, wherein said clay comprises montmorillonite.

31. A composite pallet member comprising:

at least one deck member having a first surface and a second surface;

said deck member having a plurality of open spaces in said first and second surfaces; and a strengthening layer positioned against at least one of said first surface and said second surface, said strengthening layer at least partially closing at least some of said open spaces in said at least one surface, wherein a first set of said plurality of open spaces extend from said first surface toward said second surface and terminate in a closed end at said second surface, and a second set of said plurality of open spaces extend from said second surface toward said first surface and terminate in a closed end at said first surface, wherein said open spaces decrease in cross-sectional area as said open spaces extend toward their respective closed ends.

32. The composite pallet member according to claim 31, wherein said plurality of open spaces are arranged in a honeycomb configuration.

33. The composite pallet member of claim 31, further comprising a strengthening layer positioned against said first surface and a strengthening layer positioned against said second surface.

34. The composite pallet member according to claim 31, wherein said strengthening layer is attached to at least one of said first surface and said second surface.

35. The composite pallet member according to claim 31, wherein said strengthening layer is detachably coupled to at least one of said first surface and said second surface.

36. The composite pallet member according to claim 31, wherein said strengthening layer is composed of at least one material chosen from the group of materials consisting of wood, plastic, particle board and metal.

37. The composite pallet member according to claim 31, wherein said deck member is composed of at least one material chosen from the group of materials consisting of wood, plastic, particle board and metal.

38. The composite pallet member according to claim 31, wherein said pallet member further comprises a plurality of deck members having a plurality of open spaces.

39. The composite pallet member according to claim 31, wherein said strengthening layer includes a plurality of holes.

40. The composite pallet member according to claim 31, wherein said plurality of open spaces are filled with at least one filler selected from the group consisting of foam, expanded metal and solid substrate.

41. The composite pallet member according to claim 31, wherein said pallet member includes a plurality of mechanically integrated legs.

42. The composite pallet member according to claim 41, wherein said legs are composed of at least one material chosen from the group of materials consisting of wood, plastic, particle board and metal.

43. The composite pallet member according to claim 41, wherein a plurality of deck members are attached to a surface of said deck member forming a shelving member.

44. The composite pallet member according to claim 43, wherein said plurality of deck members are detachably coupled to said deck member to form said shelving member.

45. The composite pallet member according to claim 43, wherein said plurality of deck members are collapsible.

46. The composite pallet member according to claim 31, wherein said strengthening layer completely closes said open spaces in said at least one surface.

47. The composite pallet member according to claim 46, wherein said strengthening layer completely closes said open spaces in both said first and second surfaces.

* * * * *